United States Patent [19]

Tolley et al.

[11] 4,276,083

[45] Jun. 30, 1981

[54] RECOVERY OF METAL VALUES FROM A METAL BEARING SOURCE OF NICKEL AND VANADIUM

[75] Inventors: William K. Tolley, Arlington Heights; William C. Laughlin, Hoffman Estates; William Rostoker, Chicago, all of Ill.

[73] Assignee: UOP Inc., Des Plaines, Ill.

[21] Appl. No.: 90,217

[22] Filed: Nov. 1, 1979

[51] Int. Cl.[3] ..... C22B 23/02; B22F 9/00

[52] U.S. Cl. ..... 75/82; 252/411 S; 423/62; 423/138

[58] Field of Search ..... 75/82, 84; 252/411 S; 423/62, 138

[56] References Cited

U.S. PATENT DOCUMENTS

| | | | |
|---|---|---|---|
| 4,163,709 | 8/1979 | Burk | 252/411 S |
| 4,203,759 | 5/1980 | Metrailer et al. | 423/62 |

*Primary Examiner*—M. J. Andrews

*Attorney, Agent, or Firm*—James R. Hoatson, Jr.; Raymond H. Nelson; William H. Page, II

[57] ABSTRACT

Metal values may be recovered from metal bearing sources which contain at least two metals, at least one of which is in the form of a sulfide, by treating the aforesaid source with a mild oxidant at an elevated temperature in the range of from about 600° to about 1500° C. whereby at least one metal value is converted to an oxide and at least one metal value is converted to the elemental state which contains a relatively minor amount of sulfur. Thereafter the metal compounds may be separated and recovered by conventional means.

13 Claims, No Drawings

RECOVERY OF METAL VALUES FROM A METAL BEARING SOURCE OF NICKEL AND VANADIUM

BACKGROUND OF THE INVENTION

Desirable metal values are found in a wide variety of metal sources including ores, slags, sands, or petroleum feed stocks. In the latter case, the metals are present as impurities or contaminants. The presence of these organometallic contaminants in petroleum crude oils will exert a deleterious effect upon many catalysts which are utilized when these crude oils are subjected to various processes. Generally speaking, the metal contaminants which are present in these petroleum crude oils will comprise nickel and vanadium although other metals including iron, copper, etc., are also often present. While it is possible to concentrate the metallic contaminants which exist in the crude oils as organometallic species or sulfides by currently known techniques, it is relatively difficult to effectively separate the metal values.

The separation of desirable metal values in the form of elemental metals or salts thereof may become commercially attractive due to the desirability of obtaining these purified metals for use in the chemical industry as well as various other industries. For example, in the case of vanadium, vanadium values such as vanadium metal or vanadium oxides are useful for many purposes in the chemical industry. As a specific example of this vanadium metal may be used as the target material for X-rays, in the manufacture of steel, or in the manufacture of vanadium compounds such as catalysts or alloys. Likewise, vanadium oxides such as vanadium pentoxide are used as the starting material for other vanadium salts, as a catalyst for the oxidation of sulfur dioxide, as a gasoline catalyst, as a catalyst for organic reactions, as a ceramic coloring material, for inhibiting ultraviolet transmission in glass, in black inks, in photographic developers, in dying textiles, in medicines, etc. Heretofore, the obtention of vanadium values from vanadium containing sources has been effected in a wide variety of processes. For example, the vanadium containing material can be subjected to the action of sulfuric acid, sodium oxychloride, hydrochloric acid, nitric acid, etc. In addition, prior methods have also utilized certain ammonium salts such as ammonium chloride, ammonium sulfide, etc., as the precipitating agent whereby insoluble vanadium salts are formed. However, each of these methods possesses certain disadvantages. For example, when utilizing acidic compounds such as hydrochloric acid, nitric acid, sulfuric acid, etc., the problem of clean-up of unwanted chemical compounds necessitates the use of relatively expensive and complicated apparatus in order to avoid the problem of polluting the environment. Conversely, when utilizing ammonium salts such as ammonium chloride as exemplified by the method set forth in U.S. Pat. No. 3,320,024 in which ammoniacal ammonium chloride is used to precipitate ammonium metavanadate, the problem of an eventual buildup of chloride ions is present. This buildup is unwanted in view of the fact that the mother liquor will, after the caustic leach, eventually contain an amount of salt such as alkali chlorides which are of insufficient caustic strength to take the vanadium into solution during the leaching operation.

As will hereinafter be shown in greater detail, it has now been discovered that desirable metal values may be recovered from a metal bearing source which contains a plurality of metal values, at least one of which is in the form of a sulfide, by a relatively simple and economical process.

This invention relates to a process for the recovery of diverse metal values. More specifically, the invention is concerned with a process for the recovery of diverse metal values from a metal bearing source which contains a plurality of metal values in various forms, at least one form of which is a sulfide.

It is therefore an object of this invention to provide an efficient process for the recovery and separation of desirable metal values.

In one aspect an embodiment of this invention resides in a process for the recovery of metal values from a metal bearing source containing at least two metal values, at least one of which is in the form of a sulfide, which comprises treating said source in the presence of a mild oxidant selected from the group consisting of carbon dioxide, water, sulfur dioxide, and mixtures thereof to convert at least one metal to an oxide, separating the resultant metallic phase from at least one oxide phase, and recovering the desired metal values.

A specific embodiment of this invention is found in a process for the recovery of metal values from a metal bearing source containing nickel and vanadium, said nickel being in the form of a sulfide, which comprises treating said source in the presence of carbon dioxide at a temperature in the range of from about 600° to about 1500° C. to convert said nickel sulfide to elemental nickel containing a relatively small amount of a nickel sulfide and vanadium oxide, separating said nickel containing sulfur from vanadium oxide and recovering the desired metals.

Other objects and embodiments will be found in the following further detailed description of the present invention.

As hereinbefore set forth the present invention is concerned with a process for the recovery of metal values from a metal bearing source containing a plurality of metals. The recovery and separation of the desired metal values is effected by treating the source at an elevated temperature with a mild oxidant whereby a selective oxidation is achieved. In many metal bearing sources the metals are present in the form of a sulfide and by utilizing these selective oxidation treatments it is possible to oxidize one or more metals while at least one metal present remains in the form of a sulfide. The mild oxidizing agents which are employed in the process of this invention will include carbon dioxide, water, sulfur dioxide, etc., or mixtures thereof. The selective oxidation step is usually effected at an elevated temperature in the range of from about 600° to about 1500° C. for a period of time which may range from about 1 to about 20 hours or more in duration. Following the selective oxidation of the metal values in the source, it is possible to effect a separation of the various metal values by conventional means known in the art such as magnetic separation, flotation, differential elution, riffling, sizing, etc.

As an example of the recovery of desired metal values utilizing the process of this invention, a dragstream resulting from the hydrorefining of a hydrocarbon charge stock containing metal contaminants such as nickel and vanadium and which may also contain an added amount of metal contaminant which may be present due to the metallic catalyst which has been used in the hydrocracking reaction is subjected to a solvent extraction. The solvent extraction is effected by passing the dragstream through a solvent such as toluene, the xylenes, pentane, hexane, etc., whereby any light hydrocarbons which are present in the dragstream are removed. Following this the dragstream may, if so desired, be subjected to an additional process for the removal of any volatile material still contained therein by pyrolyzing the material at a temperature in the range of from about 350° to about 550° C. in the presence of a non-oxidizing gas stream such as nitrogen, etc. The resulting material which comprises a mixture of carbon and the metal contaminants which may be in the form of sulfides such as nickel sulfide and vanadium sulfide are then treated with the aforementioned mild oxidant at a temperature in the range of from about 600° to about 1500° C. When utilizing a mild oxidant such as carbon dioxide the vanadium sulfide which is present in the mixture will be converted to a vanadium oxide such as vanadium trioxide, while the nickel sulfide will be converted to the metallic metal powder which will contain a relatively small amount of some residual sulfur. The carbon which is present will react with the carbon dioxide and some carbon monoxide which may be recovered and passed through and oxidation zone or chamber wherein it is admixed with air or oxygen to form carbon dioxide, this then being utilized as the mild oxidant in a recycle process.

The mixture of nickel and vanadium trioxide resulting from the roasting step may then be separated and recovered. One particular separation step which may be employed will comprise a magnetic separation inasmuch as the nickel mixture is magnetic in nature and is easily separable from the vanadium.

The process of this invention may be effected in any suitable manner and may comprise either a batch or continuous type of operation. For example, when a batch type of operation is employed, the metal bearing source such as an ore or a dragstream from a hydrocarbon refining process may be subjected to preparative steps prior to being subjected to the mild oxidant roast. For example, an ore may be ground or comminuted to a desired particle size which may be from about ¼ inch to about 400 mesh. The grinding may be accomplished by means of a ball mill, a rolling mill, roll crushers, etc. As hereinbefore set forth, if the metal bearing source is from a hydrocarbon refining process, the volatile material which may still be contained therein is removed by solvent extraction, distillation, pyrolysis, etc., and thereafter the material containing a plurality of metal values at least one of which is in the form of a sulfide is subjected to the oxidation roast in the presence of a mild oxidant such as carbon dioxide, water, sulfur dioxide, etc., or mixtures thereof. The decarbonization of the source is effected in this step which also results in a selective oxidation of at least one of the metal values to form an oxide thereof, at least one of the other metal values remaining in the sulfide form. The resultant mixture of metal values in different forms is then recovered from this step and subjected to conventional means of separation hereinbefore set forth whereby the desired metal values are recovered.

It is also contemplated within the scope of this invention that the process may be effected in a continuous manner of operation. When this type of operation is employed the metal bearing source is continuously charged to an apparatus wherein it is ground to a preferred particle size. The resulting particles are then continuously withdrawn from this zone and passed to a second zone wherein any volatile material which may still be present in the source is removed utilizing conventional means of the type also hereinbefore set forth in greater detail. After removal of the volatile material the metal bearing source is continuously charged to an oxidation zone wherein it is contacted with a mild oxidant of the type previously discussed at an elevated temperature in the range of from about 600° to about 1500° C. After passage through this zone for a predetermined period of time wherein a selective oxidation is effected, the metal values, at least one of which will be in the oxide form, while at least one will be in the elemental metal form, are continuously withdrawn and passed to a separation zone such as a magnetic separator wherein the metal values are separated and recovered. After recovery the metal values may then be converted to the elemental form to an oxide form, etc., whereby they are placed in a form suitable for use in further chemical reactions.

The following examples are given to illustrate the process of this invention. However, it is to be understood that these examples are given merely for purposes of illustration and that the present process is not necessarily limited thereto.

EXAMPLE I

To illustrate the ability to separate metal values a 10 gram sample comprising equal portions of nickel sulfide and vanadium pentoxide was poured into a quartz test tube which was thereafter placed in a furnace tube. The tube was then heated to a temperature of 300° C. over a period of about 2 hours and held at 300° C. for an additional period of 1 hour while subjecting the sample to a stream of carbon dioxide which was introduced at a rate of about 200 ml/min. During this period the off-gas was vented. After a thorough equilibration at this temperature of 300° C., the off-gas vent was connected to a condenser in a dry ice bath and the temperature was increased at a rate of about 200°/hour until a final temperature of 950° C. was reached. The sample was then subjected to the carbon dioxide stream for a period of 14 hours. At the end of this period heating was discontinued and after the sample had been allowed to cool to room temperature, it was recovered and slurried in water. The slurry was then subjected to magnetic treatment and the metallic portion which was attracted to the magnet, comprising impure nickel, was recovered and dried with acetone. The non-magnetic portion was filtered and dried. Analysis of the solid portion by X-ray disclosed only a strong vanadium trioxide pattern.

EXAMPLE II

Similar separation results may be obtained when a metal bearing source containing nickel sulfide and vanadium oxide are subjected to the action of other mild oxidants such as sulfur dioxide and water at a temperature of about 1000° C. for a period of about 14 hours. The nickel sulfide portion of the metal bearing source may be converted to metallic nickel containing a relatively small portion of sulfur while the vanadium oxide will remain in the oxide form and thus permit the magnetic separation of nickel from the vanadium oxide.

We claim as our invention:

1. A process for the recovery of metal values from a metal bearing source containing nickel and vanadium, the nickel being in the form of a sulfide, which comprises treating said source with a mild oxidant selected from the group consisting of carbon dioxide, water, sulfur dioxide, and mixtures thereof at conditions to convert the nickel sulfide to metal and the vanadium to an oxide, and separating the resultant metallic nickel from the vanadium oxide.

2. The process as set forth in claim 1 in which said treatment with said mild oxidant is effected at a temperature in the range of from about 600° to about 1500° C.

3. The process as set forth in claim 1 in which said mild oxidant is carbon dioxide.

4. The process as set forth in claim 1 in which said mild oxidant is water.

5. The process as set forth in claim 1 in which said metal bearing source comprises a hydrocarbon feed containing metal contaminants.

6. The process as set forth in claim 5 in which said metal contaminants comprise nickel sulfide and vanadium sulfide.

7. The process as set forth in claim 5 in which said nickel bearing source is treated to remove volatile substituents prior to treatment with said mild oxidant.

8. The process as set forth in claim 7 in which said volatile substituents are removed by solvent extraction.

9. The process as set forth in claim 7 in which said volatile substituents are removed by distillation and pyrolysis.

10. The process as set forth in claim 9 in which said pyrolysis is effected at a temperature in the range of from about 350° C. to about 550° C.

11. The process as set forth in claim 1 in which the separation of the metallic nickel from the vanadium oxide is effected by magnetic separation.

12. The process as set forth in claim 1 in which the separation of the metallic nickel from the vanadium oxide is effected by flotation.

13. The process as set forth in claim 1 in which the separation of the metallic nickel from the vanadium oxide is effected by elution.

* * * * *